US006058812A

United States Patent [19]

Casel et al.

[11] Patent Number: 6,058,812

[45] Date of Patent: May 9, 2000

[54] SCREWING TOOL WITH A RATCHET

[75] Inventors: André Casel; Herbert Casel; Gerd Nebe, all of Wuppertal; Stefan Häckel, Essen, all of Germany

[73] Assignee: Robert Schroder GmbH & Co., Wuppertal, Germany

[21] Appl. No.: 09/099,771

[22] Filed: Jun. 19, 1998

[30] Foreign Application Priority Data

| | | | |
|---|---|---|---|
| Jun. 19, 1997 | [DE] | Germany | 297 10 771 U |
| Aug. 20, 1997 | [DE] | Germany | 297 14 906 U |

[51] Int. Cl.[7] ..... B25B 13/46

[52] U.S. Cl. ..... 81/60; 81/63.1

[58] Field of Search ..... 81/60, 63.1

[56] References Cited

U.S. PATENT DOCUMENTS

| | | | |
|---|---|---|---|
| 508,706 | 11/1893 | Hand | 81/63.1 |
| 538,525 | 4/1895 | Kleinfeldt | 81/63.1 |
| 850,566 | 4/1907 | Cook | 81/63.1 |
| 873,363 | 12/1907 | Foss | 81/63.1 |
| 5,069,091 | 12/1991 | Bramsiepe et al. | 81/177.7 |

FOREIGN PATENT DOCUMENTS

| | | |
|---|---|---|
| 0 661 139 | 7/1995 | European Pat. Off. . |
| 1 906 333 | 9/1970 | Germany . |
| 25 13 648 | 9/1976 | Germany . |
| 37 05 663 | 5/1988 | Germany . |
| 39 09 429 | 9/1990 | Germany . |
| 92 08 547 | 10/1992 | Germany . |
| 93 18 291 | 4/1994 | Germany . |
| 94 07 099 | 8/1994 | Germany . |
| 295 14 482 U | 12/1995 | Germany . |
| 2 082 103 | 3/1982 | United Kingdom . |

OTHER PUBLICATIONS

"Conrad Baumann Werkzeug–Fabrik", "Weltrecord", Gegründet 1919, 11 pages.

*Primary Examiner*—James G. Smith
*Assistant Examiner*—David B Thomas
*Attorney, Agent, or Firm*—Nixon Peabody LLP; David S. Safran

[57] ABSTRACT

Screwing tool (1) with a handle (2), tool holding fixture (3) and ratchet (4), in which the ratchet has a pivotally mounted ratchet element (6) which has several catch cams (5), and a first stop bolt (7), in which stop bolt (7) can be engaged with ratchet element (6) by displacement in an axial direction (9) defined by axis of rotation (8), such that handle (2) can turn relative to the tool holding fixture (3) in a first direction of rotation and can be locked by form-fit in the opposite second direction of rotation. Furthermore, the ratchet (4) has a second stop bolt (7) which can be engaged with ratchet element (6) by displacement in the axial direction (9) such that the handle (2) can turn relative to the tool holding fixture (3) in a second direction of rotation and can be locked by form-fit in the first direction of rotation, and a switching device (10) is associated with the two stop bolts (7) to switch the direction of rotation in which the locking action occurs by selectively disengaging the stop bolts (7).

14 Claims, 5 Drawing Sheets

SCREWING TOOL WITH A RATCHET

BACKGROUND OF THE INVENTION

1. Field of the Invention

The invention relates to a screwing tool with a handle, a tool holding fixture and a ratchet, the ratchet comprising a pivotally mounted ratchet element which has several catch cams, and a first stop bolt, in which the stop bolt can be engaged with the ratchet element by displacement in one axial direction defined by the axis of rotation, such that the handle can turn relative to the tool holding fixture in a first direction of rotation and can be locked by form-fit in the opposite, second direction of rotation.

2. Description of Related Art

A screwing tool of this type with only one stop bolt is known from practice. Here the stop bolt is supported to move axially and is pretensioned by a spring to the ratchet element. On its end which engages the ratchet element the stop bolt has a bevel and can be swivelled by means of a lever such that on the one hand the direction of rotation of the ratchet can be switched and on the other the ratchet can be locked at the same time in two directions of rotation.

In the aforementioned structure the disadvantage is that the ratchet mechanism relative to the size can withstand only very low locking forces, therefor it is not suited for transfer of high torques. Furthermore, switching of the locking direction by the swivelling lever and the required swivel support of the stop bolt are not optimum.

SUMMARY OF THE INVENTION

Therefore the object of this invention is to improve a screwing tool with the initially mentioned features such that a compact structure with economy of manufacture is enabled and that the screwing tool can transfer relatively high torques.

This object is achieved in accordance with the invention proceeding from a screwing tool with the initially mentioned features by the ratchet comprising a second stop bolt which can be engaged with the ratchet element by displacement in the axial direction, such that the handle can turn relative to the tool holding fixture in a second direction of rotation and can be locked by form-fit in the first second direction of rotation, and by the ratchet comprising a switching device which is assigned to the two stop bolts so that to switch the direction of rotation in which the locking action occurs, the stop bolts can be selectively disengaged from the ratchet element by the switching device.

One idea of this invention is to use only axially movable stop bolts to enable a compact structure.

Another idea is that one stop bolt at a time can block one direction of rotation of the ratchet. This enables structural simplification since the swivel bearing of the stop bolts otherwise provided and the swivelling lever can be omitted.

Furthermore, the two stop bolts which are supported not to turn ensure a high load capacity of the screwing tool or the ratchet so that high torques can be transferred.

One preferred embodiment is characterized by the fact that the ratchet element is made essentially annular and on one face has radially running grooves with interposed bridges to form the catch cams. This enables relative ease of production, the load capacity of the ratchet depending largely on the dimensioning of the bridge and the arrangement of the grooves determines the fineness of the catch.

In particular it is provided that the stop bolts are made elongated and essentially opposite one another parallel to the axis of rotation. This can be attributed to the compact structure.

In one especially preferred embodiment the stop bolts in contrast to the directly opposite position are arranged offset or displaced roughly in the peripheral direction, especially by 2 degrees at a time. Here the peripheral angle between the two stop bolts relative to the axis of rotation is therefore for example 176 degrees. The asymmetrical arrangement of the stop bolts enables or facilitates optimum arrangement of the catch cams or the grooves into which the stop bolts can fit. Here, optimization is effected by the fact that, on the one hand, a catch as fine as possible is obtained, and on the other hand, catch cams which can withstand very high loads are obtained.

With respect to the aforementioned optimization one alternative or additional version calls for the width of the stop bolts being greater in the peripheral direction than the interior width between the catch cams in the peripheral direction. Here then the stop bolts do not fit between the catch cams with their entire width, so that on the one hand a fine catch, therefore a large number of catch cams, can be provided on the ratchet element and on the other hand a ratchet designed for transfer of high torques can be built with relatively small size.

One simple embodiment arises by each stop bolt on its end facing the ratchet element having a slip surface which acts in one direction of rotation for the catch cams and a blocking surface which acts in the other direction of rotation for abutting one catch cam and by the slip surfaces of the two catch cams being oppositely bevelled in the peripheral direction. In this way relatively large bearing surfaces with relatively low surface pressure and ease of movement of the ratchet can be achieved.

Based on at least two stop bolts, in contrast to the prior art it is possible according to one possible embodiment that each stop bolt is guided not to be able to turn in one axial groove and is pretensioned by a spring to the ratchet element.

Preferably the switching device is made such that in one locking direction the two stop bolts can be engaged at the same time with the ratchet element. Thus, above and beyond the switching capacity of the locking direction of the ratchet the latter can also be completely locked. For blocking which acts in the two directions of rotation a corresponding position of the stop bolt and the catch cams is necessary to be able to achieve minimum rotary play between the handle and tool holding fixture.

One very simple and preferred embodiment is characterized by the switching device being made such that the stop bolt can be moved back selectively from the ratchet element in the axial direction. In this way, for two stop bolts one at a time is disengaged from the ratchet element with a corresponding position of the switching device so that only the other stop bolt can block the ratchet in the corresponding direction of rotation.

A simple structure of the switching device results from its comprising an actuator which can be displaced in the peripheral direction and which can be engaged to the stop bolt for moving it back from the ratchet element via beveled abutting surfaces.

In particular with respect to a compact structure it is provided that the actuator is made in the manner of an annular segment and has bevelled ends to form the abutting surfaces and that the abutting surfaces can be engaged with the groove-like recesses of the stop bolts.

In this embodiment a middle position of the actuator in which the two stop bolts engage the ratchet element and thus cause locking of the ratchet in the two directions of rotation is enabled by the actuator having a length which is less than or equal to the peripheral distance of the stop bolts.

Ergonomically favorable handling arises preferably by the switching device comprising a rotary switching bush, and the actuator can be actuated by turning the switching bush. In particular, in this respect the switching bush is joined securely to the actuator.

One structurally simple design and good encapsulation of the ratchet against dirt are achieved by the switching bush surrounding the actuator, the stop bolts and catch cams, preferably also at least part of the ratchet element, on the outside.

Simple guidance for the switching bush or actuator is achieved preferably by the actuator being supported or guided to move peripherally in a peripheral groove of a holding part which pivotally mounts the ratchet element.

Here the holding part can have axial grooves for supporting the stop bolts, yielding a structure which consists of few parts.

In the preferred embodiment the handle is joined securely to the holding part, the ratchet element directly or indirectly bearing the tool holding fixture.

The proposed ratchet of compact structure allows the screwing tool to be made like a screwdriver. Preferably the handle has an end piece which can be swivelled transversely to the axis of rotation in order to achieve better lever action and accordingly larger torques if necessary.

BRIEF DESCRIPTION OF THE DRAWINGS

In the following this invention is detailed using the drawings of one preferred embodiment. In the drawings

DETAILED DESCRIPTION OF THE INVENTION

Figure 1:
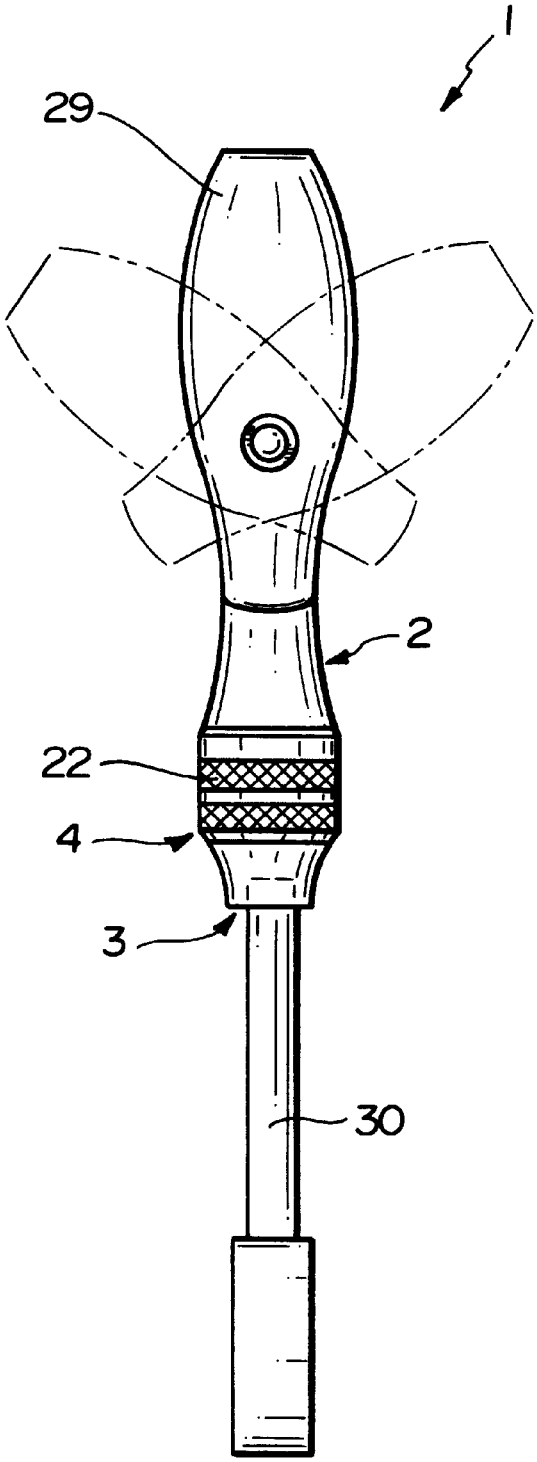
FIG. 1 shows a side view of the proposed screwing tool.

The side view in FIG. 1 shows a proposed screwing tool 1 with a handle 2, a tool holding fixture 3 and a ratchet 4 which acts between the handle 2 and the tool holding fixture 3.

Figure 2:
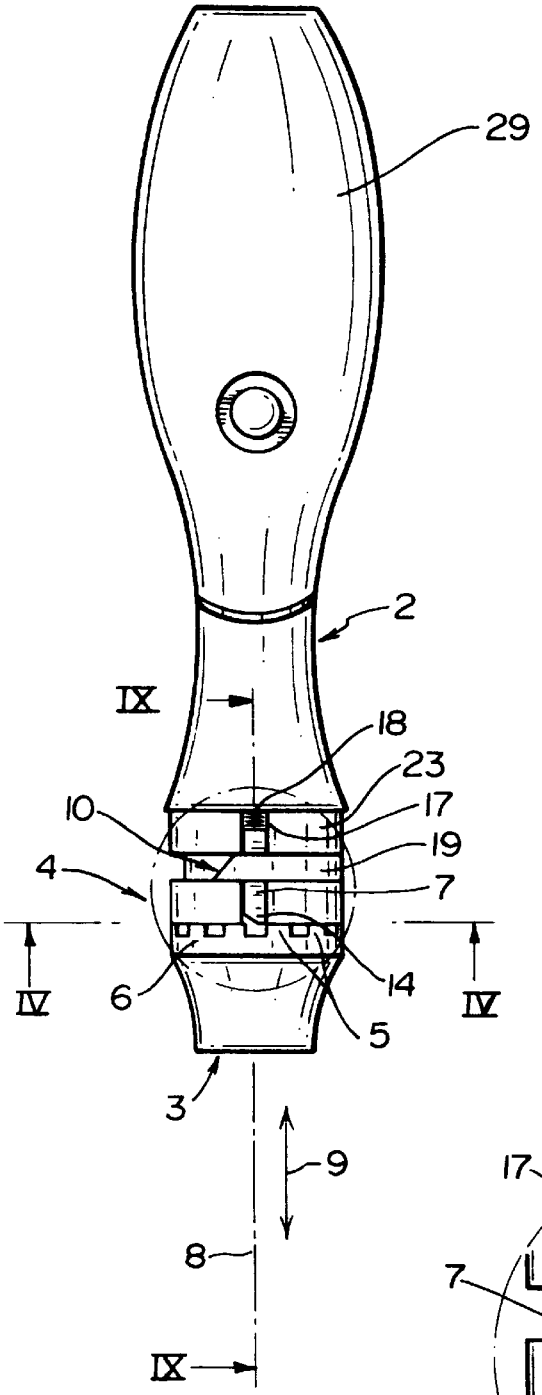
FIG. 2 shows an enlargement of a handle and a ratchet of the screwing tool shown in FIG. 1 with the switching bush removed.

As FIG. 2 shows best, the ratchet 4 comprises a ratchet element 6 which is provided with several catch cams 5 and which two stop bolts 7 can engage. To do this the stop bolts 7 are movably supported for movement parallel to the axis of rotation 8 of the ratchet 4 in the axial direction 9.

The ratchet 4 furthermore comprises a switching device 10 for switching of the locking direction of the ratchet 4. This means that by means of the switching device 10 it is possible to switch the direction of rotation in which the ratchet 4 blocks the turning of the handle 2 relative to the tool holding fixture 3 around the axis of rotation 8. In the direction of rotation opposite at the time relative turning is possible based on the ratchet 4. The switching device 10 is detailed later.

Figure 4:
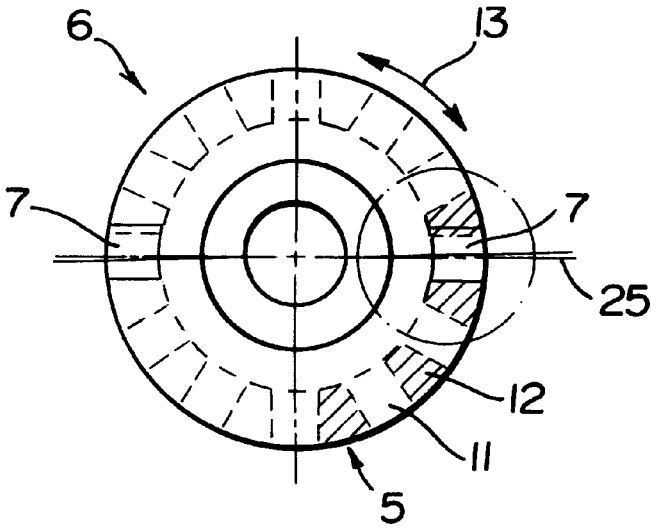
FIG. 4 shows a section of the ratchet along line IV—IV as shown in FIG. 2.

The ratchet element 6 in the embodiment is made essentially annular, as can be taken from the section in FIG. 4, catch cams 5 on one face of the ratchet element 6 being formed by radially running grooves 11 which are bordered in the peripheral direction by bridges 12 which lie in between. The catch cams 5 or grooves 11 are uniformly distributed in the peripheral direction 13 over the face of the ratchet element 6 which faces the stop bolts 7.

Figure 8:
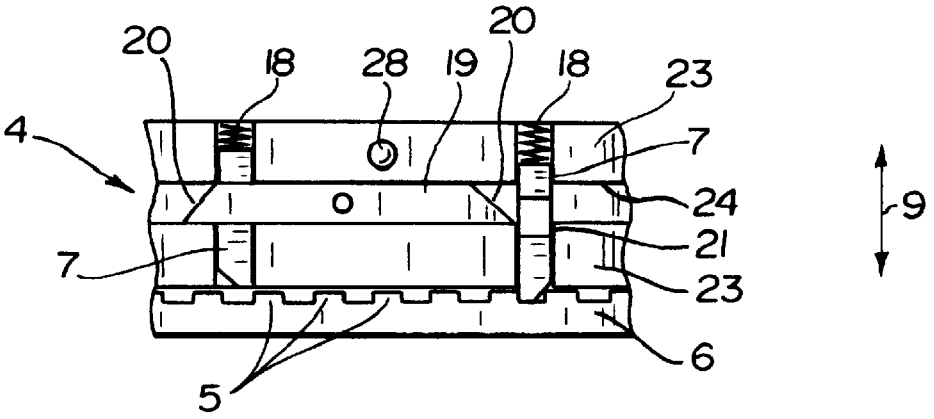
FIG. 8 shows a side developed view of the ratchet with the switching bush removed.

The stop bolts 7 are aligned with their longitudinal axes in the axial direction 9, their ends 14 facing the ratchet element 6 being made such that they can block one direction of rotation of the ratchet element 6 at a time and release the opposite direction of rotation, as is best shown in the developed view shown in FIG. 8. Here each stop bolt 7 on its end 14 has a beveled slip surface 15, the slip surfaces 15 being oppositely oriented or inclined in the peripheral direction 13. This results in that catch cams 5 with corresponding relative motion to the stop bolt 7 strike its slip surface 15 and with corresponding axial displacement of the stop bolt 7 continue to execute relative movement without catching. On the side of the stop bolt 7 facing away from the slip surface 15 in the peripheral direction 13 the locking surface 16 is formed which abuts the corresponding surface of the catch cam 5 in the opposite relative motion and causes form-fitted locking of the ratchet 4 in this direction of rotation.

The capacity of the stop bolts 7 to move axially is ensured by their being guided to move in the axial direction 9 in one axial groove 17 at a time. To each stop bolt 7 is assigned one spring 18 which pretensions the corresponding stop bolt 7 in the axial direction 9 to the ratchet element 6 so that without the action of the switching device 10 the end 14 of the respective stop bolt 7 can engage the catch cam 5. The locking direction of the ratchet 4 can be adjusted accordingly by the switching device 10 selectively disengaging one of the stop bolts 7 from the ratchet element 6 or its catch cams 5. To do this, in the embodiment one stop bolt 7 is moved selectively back from the ratchet element 6 in the axial direction 9 by the switching device 10.

Figure 3:
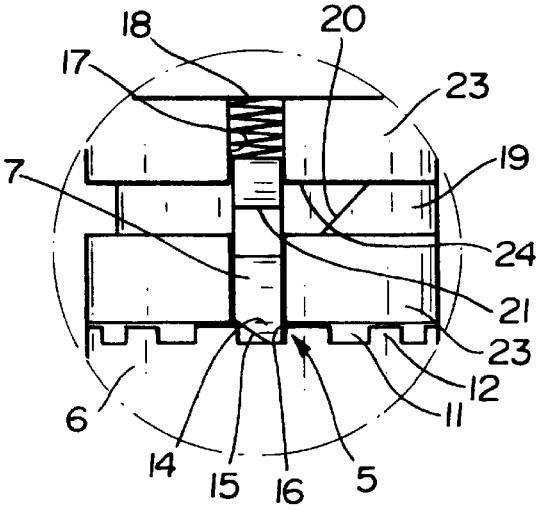
FIG. 3 shows an enlarged extract of the ratchet as shown in FIG. 2.

In the preferred embodiment shown, compare especially FIGS. 2, 3 and 8, the switching device 10 comprises the actuator 19 which is made in the form of annular segment and on its two ends has beveled abutting surfaces 20 in the peripheral direction 13. The abutting surfaces 20 and the actuator 19 are made such that one end at a time can engage the grooved or slotted recess 21 in the stop bolt 7 such that displacement of the actuator 19 in the peripheral direction 13 by the corresponding abutting surface 20 can cause axial displacement of the corresponding stop bolt 7 against the force of the assigned spring 18 away from the ratchet element 6. Depending on which of the two stop bolts 7 is moved back from the ratchet element 6 in the axial direction 9 by the actuator 19, locking action of the ratchet 4 in one corresponding direction takes place, ratchet 4 in the opposite direction of rotation allowing turning of the grip 2 relative to the tool holding fixture 3.

FIG. 8 illustrates operation of the actuator 19 and the ends 14 of the stop bolts 7 which are bevelled in mirror symmetry to one another in the peripheral direction 13 to enable selective locking in opposite directions of rotation.

In the embodiment it is important that the actuator 19 not exceed a certain peripheral length which is fixed by the peripheral distance of the stop bolts 7, to ensure that the two stop bolts 7 cannot be moved back from the ratchet element 6 at the same time in order to preclude simultaneous cancellation of the locking action of the ratchet 4 in both direction of rotation.

Figure 6:
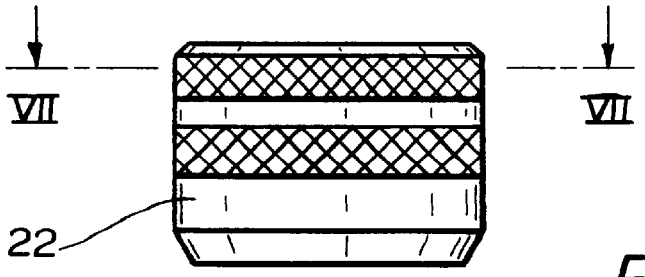
FIG. 6 shows a side view of the switching bush.
Figure 7:
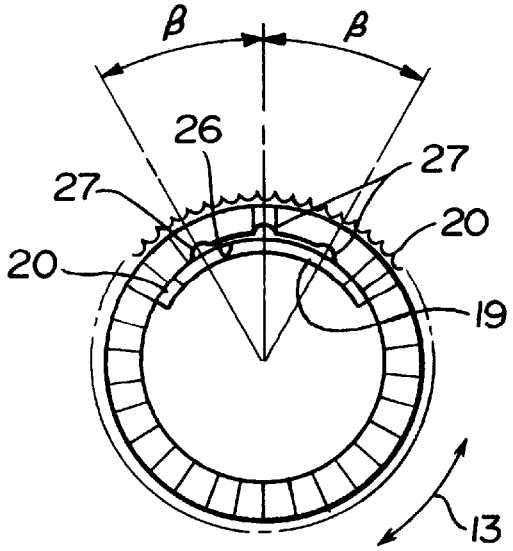
FIG. 7 shows a section of the switching bush along line VII—VII of FIG. 6.

Simple and ergonomically favorable actuation of the actuator 19 is enabled in the embodiment by the switching bush 22 of the switching device 10, the former peripherally surrounding the ratchet 4. This switching bush 22 shown in FIG. 1, 6 and 7 surrounds the entire ratchet mechanism and engages the actuator 19 such that the actuator 19 in the peripheral direction 13 can be moved around the axis of rotation 8 by turning the switching bush 22.

The proposed ratchet 4 comprises the holding part 23, which guides the actuator 19 in one peripheral groove 24, as shown in FIG. 2, 3 and 8. The holding part 23 additionally has two axial grooves 17 which cross the peripheral groove 24 and are used to axially guide the two stop bolts 7. The axial grooves 17 are made deeper than the peripheral groove 24 and each guide stop bolt 7 which is made preferably essentially as a polygonal section without the capacity to turn. The recess 21 on the stop bolt 7 is made and arranged such that the stop bolt 7 with its recess 21 located on the outside continues the peripheral groove 24 in the position which is moved axially back from the ratchet element 6. Furthermore the width of the recess 21 and the peripheral groove 24 in the axial direction 9 is greater than the maximum axial displacement of the stop bolt 7 to the ratchet element 6 in the engaged state so that the actuator 19 with its leading edge of the abutting surface 20 sloped towards the end 14 of the stop bolt 7 in each possible axial position of the stop bolt 7 fits into a recess 21 and can move the stop bolt 22 back from the ratchet element 6 in the course of further displacement of the actuator 19 in the peripheral direction 13.

Figure 5:
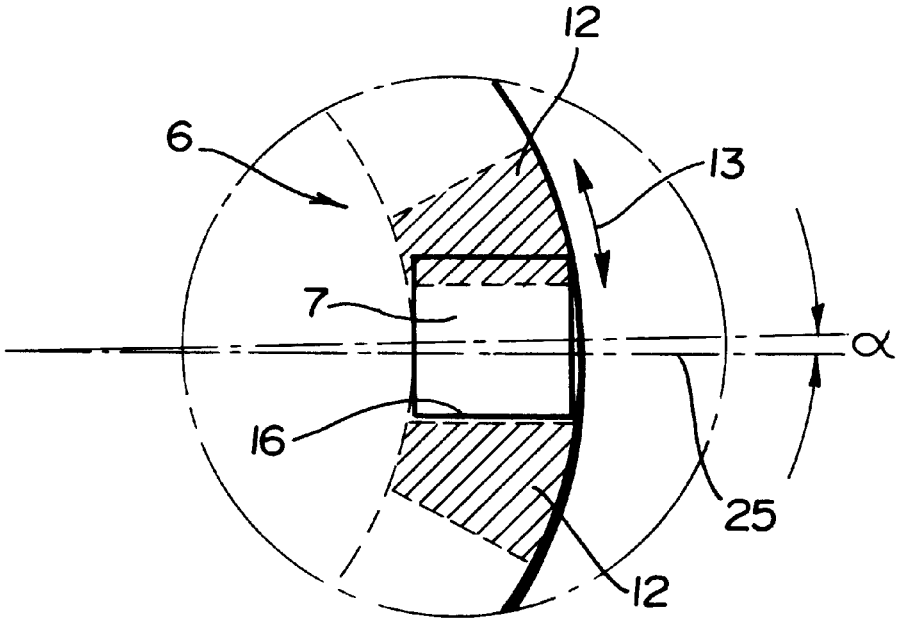
FIG. 5 shows an enlarged extract from FIG. 4.

FIGS. 3, 4, and 5 illustrate that the width of the stop bolt 7 in the peripheral direction 13 is preferably greater than the width of the grooves 11 or the inside distance between the catch cams 5 in the peripheral direction 13. By the corresponding arrangement and incline of the slip surface 15 on the stop bolt 7, the latter, in spite of the aforementioned difference in widths, can with its end 14 fit relatively deeply in the axial direction into the grooves 11 in order to cause not overly great surface pressure in the locked state for the catch cam 5 or the bridge 12 abutting the locking surface 16 and to enable a relatively high load capacity of the ratchet 4 in the locked state. Of course the load capacity of the ratchet 4 also depends largely on the width of the catch cam 5 or the bridge 12 in the peripheral direction 13.

The aforementioned width difference necessarily leads to a width ratio, i.e. the width of the stop bolt 7 to the width of the groove 11, of at least 1.1. Thus it is possible to form for example two additional catch cams 5 on the ratchet element 6 compared to the possible number of catch cams 5 for a width ratio of 1.0. This leads to a fine catch of the ratchet 4.

In the embodiment the division of the ratchet element 6 is symmetrical; grooves 11 and bridges 12 or catch cams 5 are therefore uniformly distributed over the face of the ratchet element 6 facing the stop bolt 7, such that the grooves 11 are each opposite one another in pairs with reference to the axis of rotation 8, as FIG. 4 shows.

The ratchet 4 as suggested is furthermore made such that the two stop bolts 7 can engage the ratchet element 6 at the same time in order to simultaneously block the relative turning of the handle 2 and the tool holding fixture 3, which is possible otherwise in one direction of rotation, in two direction of rotation. In this blocked position the actuator 19 is in the middle position between the two stop bolts 7 and does not engage either of the two stop bolts 7 so that they can engage the catch cams 5 unhindered.

To achieve only minimum rotary play of the ratchet 4 with the aforementioned width difference and the explained, preferably provided symmetrical division of the ratchet element 6 in the locked position, in an especially preferred embodiment, as shown in FIGS. 4 and 5, the stop bolts 7 and accordingly the axial grooves 17 are each offset by a certain offset angle $\alpha$ relative to the position exactly opposite in the peripheral direction 13 on the holding part 19. Preferably the offset angle $\alpha$ for each stop bolt 7 is roughly 2 degrees. Accordingly then the two stop bolts 7 are not directly opposite with respect to the axis of rotation 8, but are offset with a peripheral angle of less than 180 degrees, for example 176 degrees, on the holding part 23. In this way the locking surfaces 16 of the stop bolts 7 which lie on one side with respect to the diameter 25 are aligned to one another such that in their position in the peripheral direction 13 they correspond to the two stop bolts 5 or bridges 12 of the ratchet element 6 with consideration of the play necessary for catching in the corresponding grooves 11 in the peripheral direction 13.

It follows from the aforementioned that the ratchet 4 can be operated in three operating modes in which the ratchet 4 blocks relative turning of the handle 2 to the tool holding fixture 3 either only in one or only in the other direction of rotation or at the same in both directions of rotation. These operating modes can be selected by corresponding turning of the switching bush 22, the switching bush 22 being held to catch preferably in the rotary positions corresponding to the three operating modes. To do this the switching bush 22 on the inside has a catch groove 26 which extends over a certain range of peripheral angles and which fixes the turning range, with catch depressions 27 which correspond to the three rotary positions and into which fits the catch element 28 which is held by the holding part 23 and which is elastically pretensioned radially to the outside by a spring or the like, for example in the form of a catch ball.

The catch depressions 27 are offset to one another by a peripheral angle $\beta$ in the peripheral direction 13, this angle $\beta$ being for example 30 degrees. Accordingly then the switching bush 22 can be turned for switching from one operating mode of the ratchet 4 to another by 30 degrees at a time.

The ratchet element 6 and at least the stop bolts 7 are made especially of steel, preferably machining steel, for example 95MnPb28k, so that for corresponding geometrical dimensioning the ratchet 4 which can be loaded at least with a torque of 40 Nm is formed comparatively easily. A relatively economical configuration can be achieved by the holding part 19 being made of aluminum or diecast zinc and the switching bush 22 being made of plastic.

Figure 9:
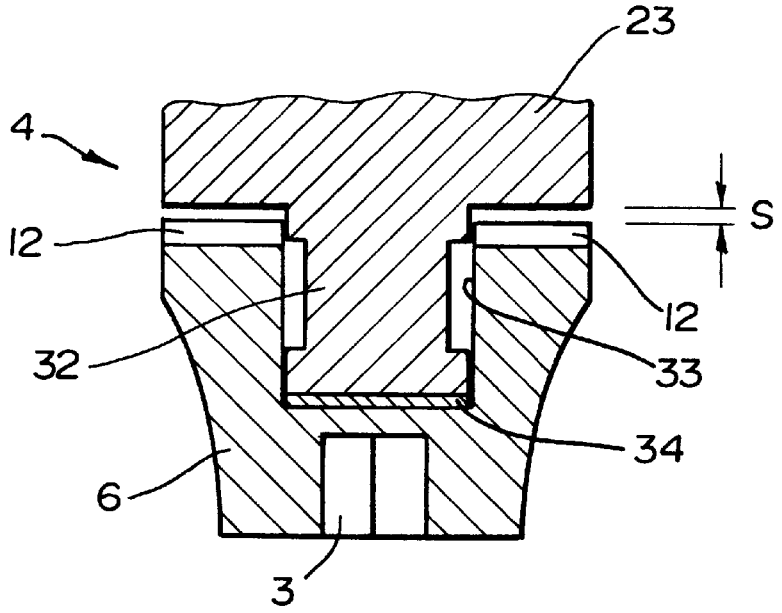
FIG. 9 shows a section of the ratchet along line IX—IX from FIG. 2.

The cross section as shown in FIG. 9 illustrates the preferred structure of the ratchet 4. The holding element 23 on its side facing the ratchet element 6 has an axially extending pin 32 which fits into an essentially complementary hole or recess 33 which is formed in the ratchet element 6 for support of the latter. Low wear and ease of movement of the ratchet 4 are preferably achieved by a shim 34 located between the free face end of the pin 32 and the closed end of the recess 33. By means of this shim 34, by choosing a corresponding thickness it is possible to equalize production tolerances and to effect the desired axial distance or gap S between the catch cams 5 or the peripheral edge of the ratchet element 6 and the holding part 23. In this way friction can be minimized in the relative turning of the ratchet element 6 and the holding part 23 to one another so that the ratchet 4 can move very easily. Furthermore, the shim 34 minimizes wear between the pin 32 and the ratchet element 6.

The proposed screwing tool 1 is made like a screwdriver. Therefore in the preferred embodiment the handle 2 formed preferably by injection molding of plastic or pressing of a corresponding plastic part directly adjoins the holding part 23 on the side facing away from the ratchet element 6.

The handle 2 on its free end has a handle end piece 29 which can be swivelled or folded down and which forms ergonomically superior handling for application of high torques in the inclined positions shown by the dotted line in FIG. 1.

The tool holding fixture 3 which is made for example in the form of a recess for holding a polygon on the face of the ratchet element 6 facing away from the stop bolts 7 or by a shaft 30 which adjoins the ratchet element 6 on the side facing away from the handle 2 is used to hold a tool to be turned with a screwing tool 1, such as a screwdriver blade, a so-called bit, a nut, an outside polygon, or the like. Preferably the tools can be detachably joined to the tool holding fixture 3 or an adjoining shaft 30. But a permanent connection of the tool to be turned to a screwing tool 1 is also possible.

Figure 10:
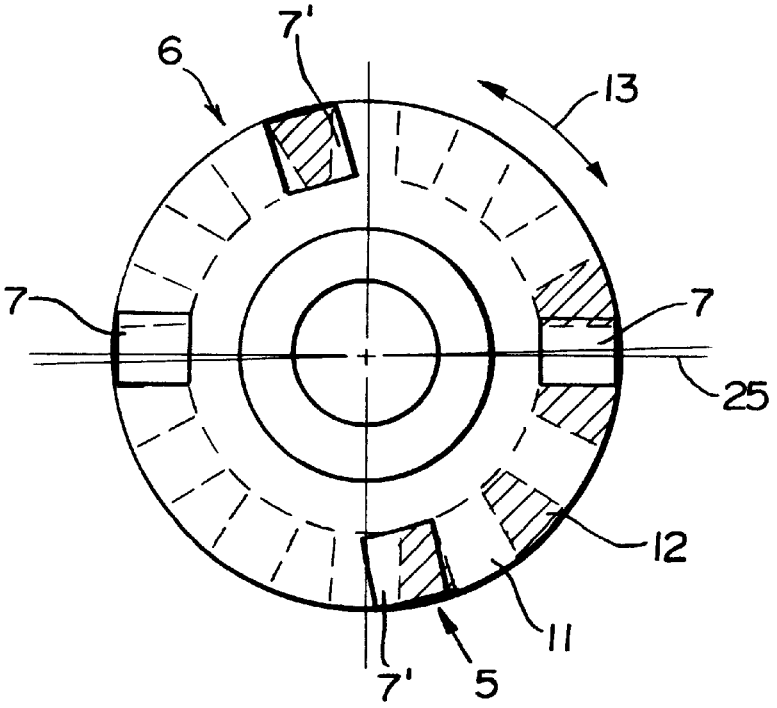
FIG. 10 is a view corresponding to that of FIG. 4 but of a modified embodiment having two pairs of stop bolts.

In the above described embodiment there are only two stop bolts 7 which act in opposite blocking directions. But it is also possible to provide additional stop bolts 7 to increase the torque transmitted by the ratchet 4 and/or to make the catch of the ratchet 4 finer. Thus it is relatively easy to provide an additional pair of stop bolts 7' offset by roughly 90 degrees in the peripheral direction 13. The stop bolts 7' can for example be arranged offset by half the catch cam distance in the peripheral direction 13 to the first pair so that the catch of the ratchet 4, i.e. the angle of rotation at which the next catch cam 5 comes to rest against the locking surface 16 of the stop bolt 7 is reduced in half (FIG. 10, extract). Alternatively it is also possible to arrange additional stop bolts 7' together with the two originally provided stop bolts 7 such that the two opposing stop bolts 7, 7' can always block the same direction of rotation at the same time, thus increasing the load capacity of the ratchet 4.

It should be pointed out that the ratchet 4 as proposed can also be used without a handle 2 or in combination with another lever arm, such as a handle which runs transversely to the axis of rotation 8.

We claim:

1. Screwing tool comprising:

a handle;

a tool holding fixture; and a ratchet including a rotatably supported ratchet element with several catch cams, a pair of first and second stop bolts, said first stop bolt being engageable with the catch cams of said ratchet element by displacement in an axial direction defined by an axis of rotation of said ratchet element, such that said handle can be turned relative to said tool holding fixture in a first direction of rotation and can be locked by a form-fit in an opposite, second direction of rotation, and said second stop bolt being engageable with the catch cams of said ratchet element by displacement in said axial direction, such that said handle can be turned relative to said tool holding fixture in said second direction of rotation and can be locked by a form-fit in said first direction of rotation, and a switching device which is associated with said first and second stop bolts so that said first and second stop bolts are selectively disengageable from said ratchet element and said catch cams for switching the direction of rotation in which the locking by said first and second stop bolts occurs;

wherein said first and second stop bolts are spaced away from said axis of rotation and arranged essentially, but not exactly, opposite one another relative to said axis being offset from 180° in a peripheral direction; wherein a width of said first and second stop bolts in the peripheral direction is greater than an interior width between adjacent ones of said catch cams; and wherein said first and second stop bolts are offset from a position directly opposite one another by 2° in the peripheral direction.

2. A screwing tool as claimed in claim 1, wherein said ratchet element is essentially annular and has radially extending grooves on a front face thereof, said radially extending grooves having interposed bridges which form said catch cams.

3. Screwing tool as claimed in claim 1, wherein said first and second stop bolts are elongated, having longitudinal axes extending essentially in said axial direction; and wherein each of said first and second stop bolts is guided in an axial groove so as to be fixed against rotation.

4. Screwing tool as claimed in claim 1, wherein said first and second stop bolts are engageable at the same time with respective ones of said several catch cams by said switching device.

5. Screwing tool as claimed in claim 1, wherein said switching device comprises an actuator which is displaceable in the peripheral direction and which is engageable with either one of said first and second stop bolts for moving it back from said ratchet element via beveled abutting surfaces engaging groove-like recesses of said first and second stop bolts; and wherein said actuator is in the formed of an annular segment and has beveled ends forming said abutting surfaces.

6. Screwing tool as claimed in claim 5, wherein said actuator has a length which is at most equal to the peripheral distance of said first and second stop bolts.

7. Screwing tool as claimed in claim 5, wherein said switching device comprises a rotatable switching bush surrounding said actuator, said first and second stop bolts and said several catch cams; and wherein said actuator is actuateable by rotation of said switching bush.

8. Screwing tool as claimed in claim 5, wherein said ratchet comprises a holding member which rotatably supports said ratchet element and comprises axial grooves for supporting said first and second stop bolts; wherein said actuator is supported so as to be movable in a peripheral groove of said holding member; and wherein said handle is securely connected to said holding member and said ratchet element bears said tool holding fixture.

9. Screwing tool as claimed in claim 1, wherein said handle comprises an end piece mounted to swivel transversely to said axis of rotation.

10. Screwing tool as claimed in claim 1, wherein said ratchet further includes an additional pair of first and second stop bolts arranged offset by half a catch cam distance such that the angle of rotation at which a next one of said several catch cams can be locked by one of said stop bolts is reduced to half that which is possible with a single pair of first and second stop bolts.

11. Screwing tool, comprising:

a handle;

a tool holding fixture; and a ratchet including a rotatably supported ratchet element with several catch cams, a pair of first and second stop bolts, said first stop bolt being engageable with the catch cams of said ratchet element by displacement in an axial direction defined by an axis of rotation of said ratchet element, such that said handle can be turned relative to said tool holding fixture in a first direction of rotation and can be locked by a form-fit in an opposite, second direction of rotation, and said second stop bolt being engageable with the catch cams of said ratchet element by displacement in said axial direction, such that said handle can be turned relative to said tool holding fixture in said second direction of rotation and can be locked by a form-fit in said first direction of rotation, a switching device which is associated with said first and second stop bolts so that said first and second stop bolts are selectively disengageable from said ratchet element and said catch cams for switching the direction of rotation in which the locking by said first and second stop bolts occurs; and and additional pair of said first and second stop bolts arranged offset by half a catch cam distance such that the angle of rotation at which a next one of said several catch cams can be locked by one of said stop bolts is reduced to half that which is possible with a single pair of first and second stop bolts; wherein said pairs of first and second stop bolts are engaged one at a time with respective ones of said several catch cams; wherein said switching device comprises an actuator which is displaceable in the peripheral direction and which are engageable with either one of said first and second stop bolts for moving it back from said ratchet element via beveled abutting surfaces engaging groove-shaped recesses of said first and second stop bolts; wherein said actuator is in the form of an annular segment and has circumferentially beveled ends which form said abutting surfaces; wherein said actuator has a length in a circumferential direction which is less or equal to the peripheral distance between said first and second stop bolts, wherein said switching device comprises a turnable switching bush surrounding said actuator, said first and second stop bolts and said several catch cams, wherein said actuator can be actuated by turning said switching bush, and wherein said ratchet comprises a holding member, which rotatably supports said ratchet element and comprises axial grooves for supporting said first and second stop bolts, wherein said actuator is supported to move in a peripheral groove of said holding member, and wherein said handle is securely connected to said holding member and said ratchet element bears said tool holding fixture.

12. Screwing tool, comprising:

a handle;

a tool holding fixture; and a ratchet including a rotatably supported ratchet element with several catch cams, a pair of first and second stop bolts, said first stop bolt being engageable with said catch cams of said ratchet element by displacement in an axial direction defined by an axis of rotation of said ratchet element, such that said handle is rotatable relative to said tool holding fixture in a first direction of rotation and can be locked by a form-fit in an opposite direction, second direction of rotation, and said second stop bolt being engageable with the catch cams of said ratchet element by displacement in said axial direction, such that said handle is rotatable relative to said tool holding fixture in said second direction of rotation and can be locked by a form-fit in said first direction of rotation, and a switching device which is associated with said first and second stop bolts so that said first and second stop bolts are selectively disengageable from said ratchet element and said catch cams for switching the direction of rotation in which the locking by said first and second stop bolts occurs, and with which said first and second stop bolts are both engageable at the same time with respective ones of said several catch cams for locking said ratchet element against rotation; wherein said switching device comprises an actuator which is displaceable in the peripheral direction and which are engageable with either one of said first and second stop bolts for moving it back from said ratchet element via beveled abutting surfaces engaging circumferentially directed groove-shaped recesses of said first and second stop bolts, said actuator being in the shape of an annular segment and having circumferentially beveled ends forming said abutting surfaces; wherein said ratchet comprises a holding member, which rotatably supports said ratchet element and comprises axial grooves for supporting said first and second stop bolts, wherein said actuator is supported to move in a peripheral groove of said holding member, and wherein said handle is securely connected to said holding member and said ratchet element bears said tool holding fixture.

13. Screwing tool as claimed in claim 12, wherein said actuator has a length which is at most equal to the peripheral distance of said first and second stop bolts.

14. Screwing tool as claimed in claim 12, wherein said switching device comprises a rotatable switching bush surrounding said actuator, said first and second stop bolts and said several catch cams; and wherein said actuator is actuated by turning said switching bush.

* * * * *